US005134595A

United States Patent [19]

Faber et al.

[11] Patent Number: 5,134,595

[45] Date of Patent: Jul. 28, 1992

[54] EASILY READ ROTARY TIMEPIECE

[76] Inventors: Ilene G. Faber; Stanley Faber, both of 629 Scotts Glen Dr., Springfield, Oreg. 97477

[21] Appl. No.: 817,646

[22] Filed: Jan. 7, 1992

[51] Int. Cl.[5] ..... G04B 19/20

[52] U.S. Cl. ..... 368/77; 368/233

[58] Field of Search ..... 368/76, 77, 233, 234

[56] References Cited

U.S. PATENT DOCUMENTS

| | | | |
|---|---|---|---|
| 864,467 | 8/1907 | Ingraham | 368/233 |
| 1,949,942 | 3/1934 | Parker | 368/77 |
| 2,051,611 | 8/1936 | Liner | 368/77 |
| 3,127,542 | 2/1885 | Pallweber | 368/233 |
| 3,533,228 | 10/1970 | Hurt | 368/77 |
| 3,672,149 | 6/1972 | Howard | 368/77 |
| 3,686,884 | 8/1972 | Hurt | 368/77 |

*Primary Examiner*—Vit W. Miska

*Attorney, Agent, or Firm*—Richard C. Litman

[57] ABSTRACT

A timepiece made up of a rotating hour plate and a rotating minute plate, a portion of the minute plate showing through a window formed through a fixed plate separating the two plates. Time of day is indicated by hour indicia on the hour plate adjacent the window with the minute is indicated through the window. An additional rotating seconds plate may be provided. The timepiece may be a twenty-four hour clock. Since both the hour and minute plates rotate, hour and minute indica are strategically positioned so that the timepiece is accurate. Various configurations of timepiece plates are shown.

12 Claims, 2 Drawing Sheets

EASILY READ ROTARY TIMEPIECE

BACKGROUND OF THE INVENTION

1. Field of the Invention

This invention relates to timepieces having rotary parts to indicate time. Some rotary timepieces incorporate hour, minute, and sometimes second indicators which are moved, wherein the time is indicated by the hour, minute, sometimes the second, within a particular region. Other rotary time pieces incorporate hour, minute, and sometimes second indicators which are stationary while the moving parts are pointers to indicate the hour, minute, and sometimes the seconds.

2. Description of the Prior Art

Rotary timepieces having hour, minute, and second indicators use moving parts to indicate the hour, minute, and second of the day at any particular time. Such time pieces require the user to read the time indicated using the judgement of the user to visually delineate a particular region of the hour, minute, and second indicators being addressed by the moving parts.

U.S. Pat. No. 312,754 issued Feb. 24, 1885 to Josef Pallweber discloses a timepiece in which the hour and minutes are indicated by rotating plates with the present time read through a window above part of the plates.

U.S. Pat. No. 864,467 issued Aug. 27, 1907 to Henry C. Ingraham discloses rotating hour, minute, and seconds plates to indicate the time as indicated by a fixed marker.

U.S. Pat. No. 3,533,228 issued Oct. 13, 1970 and U.S. Pat. No. 3,686,884 issued Aug. 29, 1972, both to Zeno Hurt disclose rotating hour, minute, and seconds plates to indicate the time as demonstrated by a particular hour of a certain color showing through a window over the rotating hour plate, a particular minute of a certain color showing through a window over the rotating minute plate, and a particular second of a certain color showing through a window over the rotating seconds plate.

None of the prior art just discussed discloses the use of a rotating minute plate and hour plate, wherein a portion of the minute plate shows through a window and the time of day is indicated by the hour indicator on the hour plate in the vicinity of the window, while the minute of the hour is indicated by the minute in the window closest to that hour indicator.

SUMMARY OF THE INVENTION

Accordingly, one object of the present invention is to provide a rotary timepiece in which the hour, minutes, and optionally the seconds, of the day can be easily read by the user.

Another object of the present invention is to provide a rotary timepiece with decorative features.

Other objects of the present invention will become clearer with further review of the following description, drawings, and claims.

The present invention makes use of an hour, minute, and, optionally, a seconds plate in which the minute plate is located below a fixed plate with a window region and the hour plate is located above the fixed plate. The minute plate has indicia of the minutes of the hour on it such that a portion of the minute indicators show through the window of the fixed plate. The hour plate has indicia of the hours of the day on it such that only one hour of the day is located substantially in the vicinity of the window region for any given time. Both the minute plate and the hour plate are rotated preferably a clockwise direction, such that the hour indicator, located substantially within the vicinity of the window region as viewed looking down at the fixed plate, indicates the hour of the day, while the minute of the hour is indicated by the minute indicator located closest to the hour indicator, as viewed looking down at the fixed plate and through the window.

DESCRIPTION OF THE PREFERRED EMBODIMENTS

Figure 1:
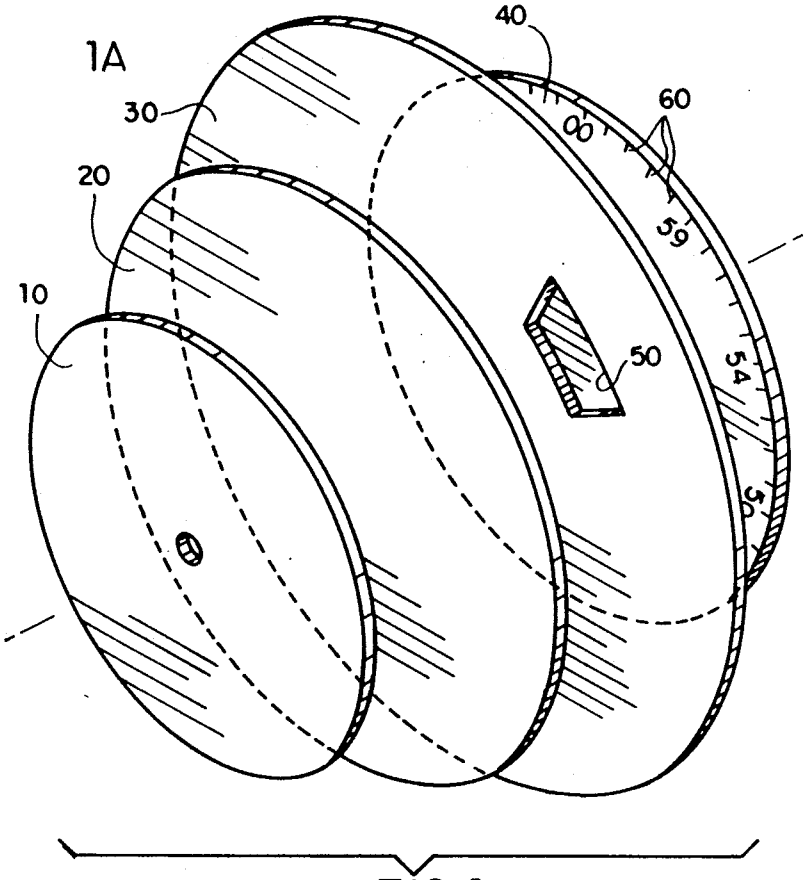
FIG. 1 is an exploded perspective view of the first embodiment of the present invention.

FIG. 1 shows the rotary timepiece 1A of the present invention which can be, for example, a wristwatch. Instead of second, minute, and hour hands used in the conventional rotary wristwatch, the present invention uses rotating plates with the hour, minutes, and seconds indicia placed on the appropriate plate. As illustrated in FIG. 1, a timepiece 1A has a seconds plate 10, an hour plate 20, a fixed plate 30, and a minute plate 40. The fixed plate 30 has a window 50 formed therethrough. The minute plate 40 has indicia 60 of the minutes of the hour which can be seen through the window 50. Since the fixed plate 30 is opaque, only that portion of the indicia 60 in the vicinity of the window can be seen from the top of the fixed plate.

Figure 2:
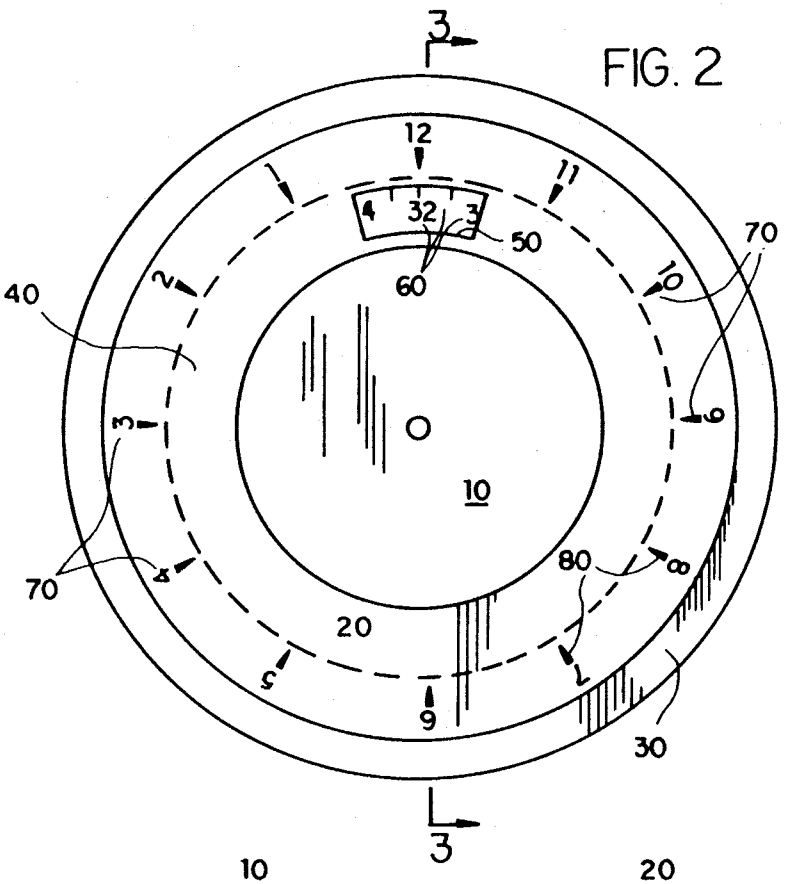
FIG. 2 is a top view of the first embodiment of the present invention.

As shown in FIG. 2, the minute indicia 60 can be seen only through the window 50. The minute plate 40 is rotated in the clockwise direction at a constant angular velocity of one revolution every hour. The hour plate 20, located above the fixed plate, is made from a transparent material so that the window 50 can be seen. The hour plate is rotated in a clockwise direction at a constant angular velocity of one revolution every twelve hours. The drives to rotate the hour plate and the minute plate at their respective velocities are conventional.

As shown in FIG. 2, the hour, minute and seconds plates share a common center of rotation. The indicia 60 of the minute plate are all located at equal distances from the common center of rotation. The hour plate 20 has indicia 70 of the hours of the day also equally spaced from the common center of rotation, but at a greater distance from the common center of rotation than the indicia 60 of the minute plate. Further, a pointer extends from indicia 70 toward the common center of rotation such that the an hour indicator within the window region when viewed from the top side of the fixed plate 30 has a pointer 80 extending along a radial direction of the common center of rotation to at least a region substantially close to the window 50 as shown in FIG. 2. However, the pointer could extend into the window region to specifically delineate a particular indicia 60 of the minute plate 40.

In FIG. 2, by way of example, the hour indicator located with the window region is twelve (12). Since the pointer 80 is pointing directly at the minute indicator thirty-two (32), then the minute of the hour is thirty-two (32). Therefore, the time indicated in the FIG. 2 is twelve thirty-two (12:32).

Figure 3:
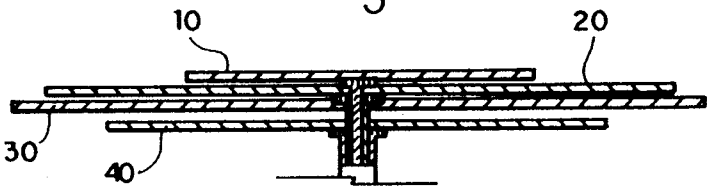
FIG. 3 is a cross-sectional view of the first embodiment of the present invention along line 3—3 of FIG. 2.

As shown in FIG. 3, the conventional seconds, minutes, and hours drives are provided for except that, instead of hands being attached to the individual drives, the plates as discussed above are used. The fixed plate 30 is not attached to any drive, but is instead connected to the body of the clock.

Figure 4B:
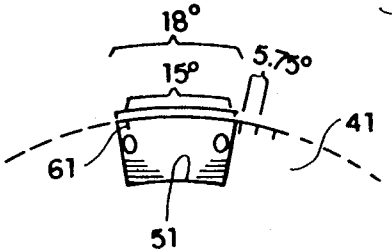
FIG. 4B is a view of the minute plate of the second embodiment of the present invention.
Figure 4A:
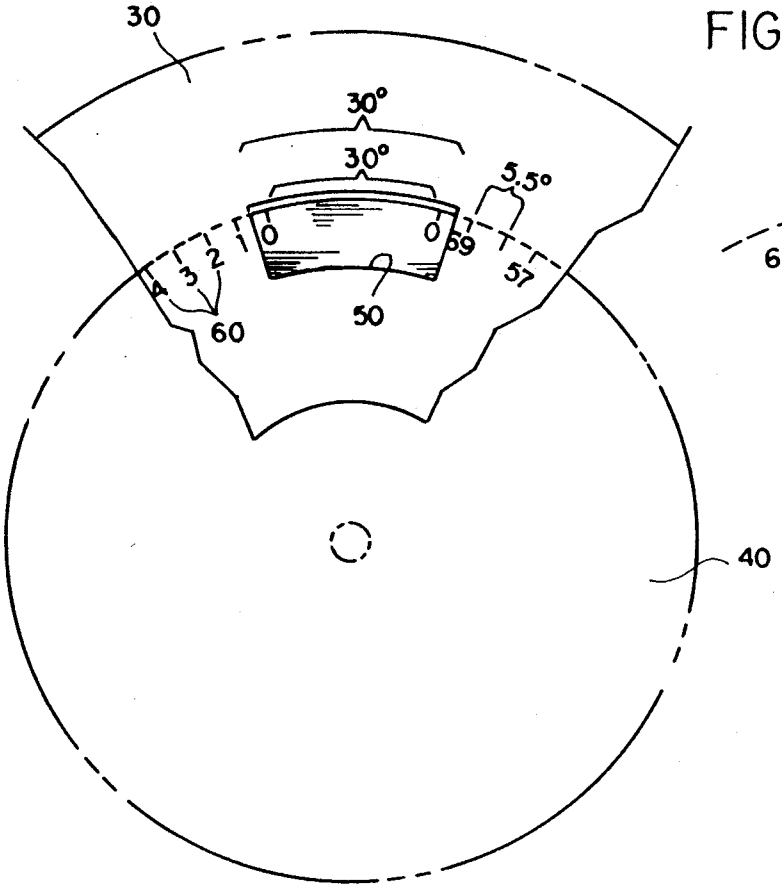
FIG. 4A is a view of the minute plate of the present invention.

In FIG. 4A, a close up view of the minute plate 40 is shown. The indicia 60 of the minute plate 40 is shown to be starting with a first zero (0) followed by the numbers one (1) through four (4). This indicia of the minutes continues all the way around the minute plate to include the numbers five (5) through fifty-six (56) but is not shown in the FIG. 4A. As shown in FIG. 4A, numbers fifty-seven, fifty-eight, fifty-nine, and the second zero follow at the end of the indicia 60. Each minute indicator from the first zero (0) to the numbers one (1) through (59) and then the second zero (0) is separated by its adjacent indicator by an angle of five and a half (5.5) degrees as measured between the two indicators from the common center of rotation. The first zero (0) and second zero (0) are separated by an angle of thirty (30) degrees as measured from the common center of rotation. The window has a first side closest to the one minute indicator with an edge located along a radial direction along the common center of rotation, as well as a second side closest to the fifty-nine (59) indicator with an edge located along another radial direction along the common center of rotation. The angle between the radius passing along said first side and the radius passing along the second side is preferably thirty-six degrees, as is illustrated.

The reason for the use of five and a half (5.5) degrees between the adjacent indicia 60 of the minute plate 40 has to do with the fact that, in the present invention, the minute of the hour is indicated by the pointer 80 nearest the window, as described above. If the pointer 80 were stationary, then the minute plate rotating at one revolution per hour, which is the same as six (6) degrees per minute, would have each minute indicator separated from its adjacent minute indicator by six (6) degrees so that the pointer 80 would be pointing at its adjacent indicator exactly one minute afterwards. However, since the pointer 80 is rotating at one revolution every twelve (12) hours, which is the same as half (0.5) a degree per minute, then with the minute plate rotating at the same speed of six (6) degrees per minute, the adjacent indicator must be half a degree closer than it would be for a stationary pointer 80 so as to make up for the half (0.5) degree the pointer 80 moved away from the adjacent indicator. Another alternative would be to speed up the rotational speed of the minute plate. In the preferred embodiment, however, the distance between the adjacent indicia 60 is just shortened by half (0.5) a degree. This means that the total angle covered between the first zero (0) through the numbers one (1) through fifty-nine (59) to the second zero is three-hundred and thirty (330) degrees, leaving 30 degrees between the two zeros.

FIG. 4B illustrates a second embodiment of the present invention different from the first invention in that it is a twenty-four hour clock. The hour plate in this embodiment would have indicia one (1) through twenty-four (24) and it would rotate at a speed of one revolution every twenty-four (24) hours or, equivalently, a quarter (0.25) of a degree a minute. Therefore, the spacing between each adjacent indicia of the minutes (61) would be five and three-quarters (5.75) degrees. This would leave 15 degrees between the two zeros.

Figure 5A:
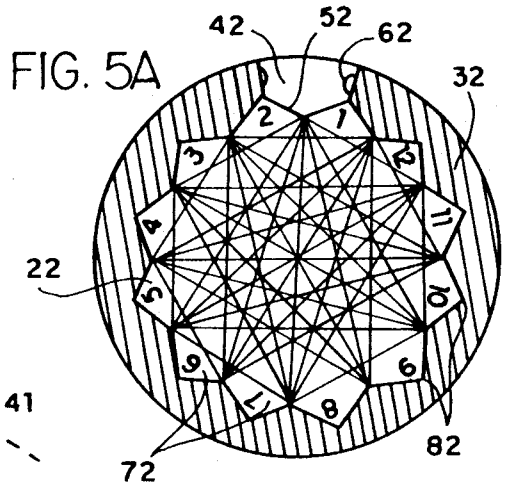
FIG. 5A is a top view of the third embodiment of the present invention.

The distance between the two zeros is necessary during a transition of the hours, for example, as when the time goes from one fifty-nine to two-o'clock. This is demonstrated by a third embodiment of the invention as shown in FIG. 5A. A timepiece is shown as being a twelve hour clock similar to the one of the first embodiment except that the hour plate 22 and the positioning of the window 52 on the fixed plate 32 are different. The minute plate 42 is identical to the minute plate 40 of the first embodiment. Instead of pointers 80, the third embodiment uses pointers 82. The hour plate 22 could be translucent or opaque. The angle between the first side of the window 52 and the second side is preferably only thirty degrees. The angle between two adjacent hour indicators is thirty (30) degrees as used in the first embodiment. Since both the first and second embodiments are twelve hour clocks, only their appearances are different. This demonstrates the various design possibilities of the present invention.

As discussed above, FIG. 5A demonstrates the transition from one fifty-nine (1:59) to two-o'clock (2:00). Just as the second zero (0) goes past the one (1) hour indicator, the two (2) hour indicator, which is thirty degrees behind the one (1) hour indicator, is at the first zero (0). Since the window 52 is only thirty degrees wide, then not all of the two zeros shows through the window at the same time.

Figure 5B:
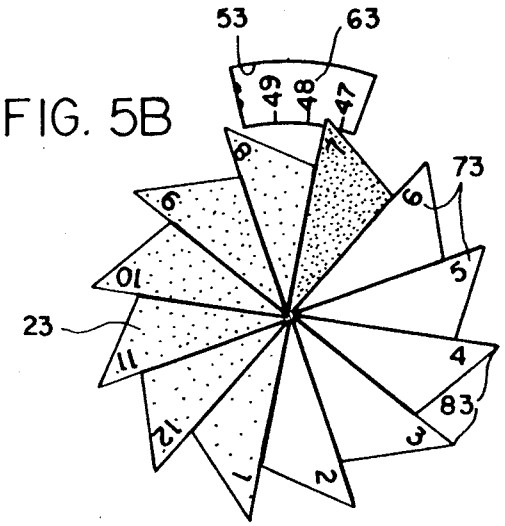
FIG. 5B is a top view of the fourth embodiment of the present invention.

FIG. 5B shows yet a fourth embodiment of the present invention in which hour plate 23 has triangular section where the tip of one of the sections serves as a pointer 83 to indicate a delineate a particular indicia of the minutes of the hour (63) as seen through a window 53 on a fixed plate (not shown).

It is clear from the above embodiments that a variety of different clock designs are possible for the present invention. Further, the rotary timepiece of the present invention is not limited to a wristwatch, but may include timepieces such as a wall clock, self-standing clock, desktop clock, or a clock incorporated into a structure having a separate utility other than telling time, such as a building, a painting, a stove, etc.

It is to be understood that the present invention is not limited to the embodiments above, but encompasses any and all of the embodiments within the scope of the following claims.

I claim:

1. A rotary timepiece comprising;

a fixed plate having a top and a bottom side and further being constructed of opaque material;

a minute plate located beneath said fixed plate comprising indicia of the minutes of the hour spaced at equal distances from a center of rotation of the minute plate;

a first drive for driving the minute plate in a rotary direction about said center of rotation of the minute plate;

an hour plate located above said fixed plate comprising indicia of the hours of the day spaced at equal distances from a center of rotation of the hour plate;

a second drive for driving the hour plate in said rotary direction about said center of rotation of the hour plate; and a window formed through said fixed plate having a first side in which an hour indicator traverses when entering the window region as viewed from the top side of the fixed plate and a second side in which an hour indicator traverses when exiting the window region as viewed from the top side of the fixed plate, wherein said window region, when viewed from said top side of said fixed plate, allows only a fraction of the minute plate to show through, such that only one hour indicator of the hour plate is located substantially within the window region for any given time and wherein the hour of the day is indicated by an hour indicator last to cross the first side of said window and the minute of the hour is indicated by a minute indicator closest to said hour indicator.

2. A rotary timepiece as claimed in claim 1, further comprising an indicator for the seconds in the minute.

3. A rotary timepiece as claimed in claim 1, further comprising:

a seconds plate located above said minute plate to be rotated about a center of said seconds plate; and, a third drive for driving the seconds plate in said rotary direction about said center of said seconds plate.

4. A rotary timepiece as claimed in claim 3, wherein said seconds plate comprises seconds indicia equally spaced from said center of said seconds plate and rotated by said third drive such that a different seconds indicator crosses a fixed reference from said fixed plate exactly once a second.

5. A rotary timepiece as claimed in claim 1, wherein said indicia of the minutes consists of markings in the shape of a first zero (0) followed by the whole integers from one (1) to fifty-nine (59) followed by a second zero (0), in that order.

6. A rotary timepiece as claimed in claim 5, wherein said indicia of the minutes from the first zero to the second zero are each separated by a first angle as measured between two adjacent minute indicators from said center of rotation of the minute plate.

7. A rotary timepiece as claimed in claim 6, wherein said second zero and said first zero are separated by a second angle as measured from said center of rotation of the minute plate.

8. A rotary timepiece as claimed in claim 7, wherein said center of rotation of said minute plate and said center of rotation of said hour plate share a common center of rotation and the edge of said first side of said window and the edge of said second side of said window are radial to said common center of rotation and are separated by a third angle as measured from said common center of rotation.

9. A rotary timepiece as claimed in claim 8, wherein said indicia of said hour plate consist of the whole integers one (1) through twelve (12), inclusive, said second drive rotating said hour plate one rotation every twelve hours, the angle between any two hour indicators being thirty (30) degrees, the third angle being thirty-six (36) degrees, the second angle being thirty (30) degrees, and the first angle being five and a half (5.5) degrees.

10. A rotary timepiece as claimed in claim 9, wherein said hour plate is transparent and the indicia of the hour plate are located further from the common center of rotation than said window, said hour plate further comprising pointers located between each of said indicia and the window when the indicia is located within the window region in such a way that the pointer extends along a radial direction of said common center of rotation from the hour indicator within the window region to at least a region substantially close to said window when viewed from the top of said fixed plate.

11. A rotary timepiece as claimed in claim 8, wherein said indicia of said hour plate consists of the whole integers one (1) through twenty-four (24), inclusive, said second drive rotating said hour plate one revolution every twenty-four (24) hours, the angle between any two hour indicators being fifteen (15) degrees, the third angle being eighteen (18) degrees, the second angle being fifteen (15) degrees, and the first angle being five and three-quarters (5.75) degrees.

12. A rotary timepiece as claimed in claim 11, wherein said hour plate is transparent and the indicia of the hour plate is located further from the common center of rotation than said window, said hour plate further comprising pointers located between each of said indicia and the window when the indicia is located within the window region in such a way that the pointer extends along a radial direction of said common center of rotation from the hour indicator within the window region to at least a region substantially close to said window when viewed from said top of said fixed plate.

* * * * *